United States Patent [19]

Brandon

[11] Patent Number: 5,038,123

[45] Date of Patent: Aug. 6, 1991

[54] FLAT ELECTROMAGNETIC RELAY

[75] Inventor: Christopher A. Brandon, Flagstaff, Ariz.

[73] Assignee: General Motors Corporation, Detroit, Mich.

[21] Appl. No.: 539,288

[22] Filed: Jun. 15, 1990

Related U.S. Application Data

[63] Continuation of Ser. No. 450,785, Dec. 14, 1989, abandoned.

[51] Int. Cl.[5] ..... H01H 50/04

[52] U.S. Cl. ..... 335/128; 335/187; 335/202

[58] Field of Search ..... 335/128, 187, 202, 78, 335/80, 84, 129

[56] References Cited

U.S. PATENT DOCUMENTS

| | | | |
|---|---|---|---|
| 4,010,433 | 3/1977 | Nishimura et al. | 335/129 |
| 4,031,493 | 6/1977 | Van Der Wielen | 335/128 |
| 4,225,835 | 9/1980 | Vrsnak et al. | 335/78 |
| 4,272,745 | 6/1981 | Tanaka et al. | 335/128 |
| 4,290,037 | 9/1981 | Inagawa et al. | 335/202 |
| 4,517,537 | 5/1985 | Weiser et al. | 335/187 |
| 4,684,909 | 8/1987 | Dittmann | 335/128 |

*Primary Examiner*—Harold Broome
*Attorney, Agent, or Firm*—F. J. Fodale

[57] ABSTRACT

A flat electromagnetic relay comprises a lead frame having six stamped insert molded circuit leads, an armature frame pivotally supporting a balanced beam armature which carries two contact bars, a coil assembly and an electromagnetic frame having two diagonally arranged pole wings which are inside the armature frame adjacent opposite side ends of the armature. The armature is torsionally biased into a first operative position where the contact bar at one end shunts two circuit leads. When the coil is energized, the armature is pivoted to a second operative position where the contact bar at the other end shunts two other circuit leads.

24 Claims, 3 Drawing Sheets

FLAT ELECTROMAGNETIC RELAY

This is a continuation of application Ser. No. 07/450,785 filed on Dec. 14, 1989, now abandoned.

BACKGROUND OF THE INVENTION

This invention relates generally to electromagnetic relays and more specifically to flat electromagnetic relays which have a very small width when vertically oriented and or a very small height when horizontally oriented.

Flat electromagnetic relays are already known from U.S. Pat. No. 4,010,433 granted to Hiromi Nishimura et al Mar. 1, 1977; U.S. Pat. No. 4,031,493 granted to Michael Van Der Wielen June 21, 1977; U.S. Pat. No. 4,272,745 to Takashi Tanaka et al June 9, 1981; U.S. Pat. No. 4,290,037 granted to Takashi Inagawa et al Sept. 15, 1981; U.S. Pat. No. 4,517,537 granted to Josef Weiser et al May 14, 1985 and from U.S. Pat. No. 4,684,909 granted to Michael Dittmann Aug. 4, 1987.

SUMMARY OF THE INVENTION

The object of this invention is to provide an improved flat electromagnetic relay which is simple in construction, economical to manufacture and very compact, and which has one or more of the following features or advantages:

A rigid insert molded lead frame which provides a strong structural support upon which the electromagnetic relay is constructed;

An in-line or coplanar terminal configuration having identical male blade terminals which are spaced apart equally;

A movable contact bar which bridges a stationary pair of contacts which are positioned next to each other to provide a low resistance current path which bypasses spring elements;

A single, flat strip of spring steel which pivotally supports an armature and a movable contact bar and which also provides an armature return spring as well as a contact pressure spring;

A balanced beam armature which pivots between two positions in seesaw fashion to bridge one pair of stationary contacts at one end of the armature while simultaneously opening another pair of stationary contacts at the other end and vice-versa;

A C-shaped electromagnetic frame which provides diagonally arranged pole wings for efficient use of the available magnetic flux in operating a balanced beam armature;

Stamped circuit leads which have exposed tips for in application electrical testing of switching and coil energizing circuits;

Normally closed and normally open switching circuits which are simultaneously opened and closed by a single coil assembly in a simple and efficient manner;

A highly symmetrical balanced beam armature which reduces the effect of external shock and vibration loading.

Other objects and features of the invention will become apparent to those skilled in the art as disclosure is made in the following detailed description of a preferred embodiment of the invention which sets forth the best mode of the invention contemplated by the inventors and which is illustrated in the accompanying sheets of drawing.

DETAILED DESCRIPTION OF THE PREFERRED EMBODIMENT

Figure 1:
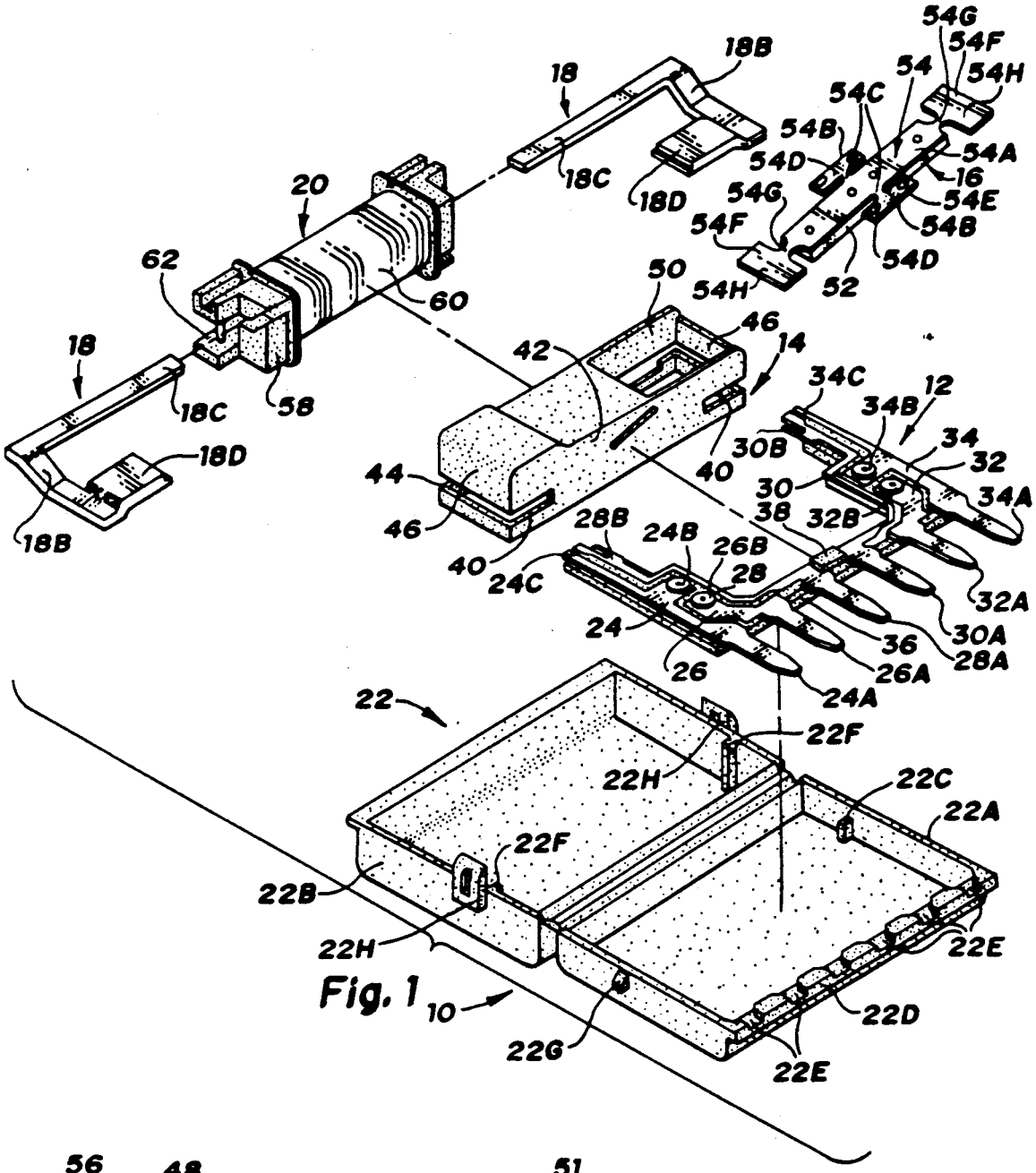
FIG. 1 is an exploded perspective view of a flat electromagnetic relay in accordance with my invention.

Referring now to the drawing and more particularly to FIG. 1, a flat electromagnetic relay in accordance with the invention is shown generally at 10 as comprising a lead frame 12, an armature frame 14, an armature assembly 16 an electromagnetic frame 18, a coil assembly 20 and a case or housing 22.

The lead frame 12 is a major structural support for the other components of the electromagnetic relay 10 and it also provides an electrical and mechanical interface for connecting the relay to other electrical devices through an automotive electrical center or the like.

The lead frame 12 comprises an arrangement of six circuit leads 24, 26, 28, 30, 32 and 34 which are stamped from a single flat sheet of high copper content alloy or other suitable electrically conductive material. The stamped leads are insert molded in a generally U-shaped thermoplastic base 36 of high temperature, high strength thermoplastic material such as a Polyester (PET). The circuit leads 24, 26, 28, 30, 32 and 34 are shaped to provide six male blade terminals **24*a*, 26*a*, 28*a*, 30*a*, 32*a* and 34*a* projecting from an edge of the molded base 36 which are coplanar, identical in width, and evenly spaced. The thermoplastic base 36 electrically isolates the six circuit leads from one another while binding them into a flat rigid lead frame 12 upon which the electromagnetic relay 10** is constructed.

The circuit leads 24, 26, 28, 30, 32 and 34 are symmetrically arranged on the U-shaped base 36 so that each side, that is, each leg and each half of the bridge connecting the legs carries three circuit leads. More specifically, the left side of the base 36 as viewed in FIG. 1 carries two larger circuit leads 24 and 26 which provide a high current switching circuit and a smaller circuit lead 28 for energizing the coil of the coil assembly 20. Similarly the right side carries two larger circuit leads 32 and 34 which provide a second high current switching circuit and a smaller circuit lead 30 which completes the circuit for energizing the coil.

The lead frame 12 further includes two pair of stationary contacts **24*b*, 26*b*, 32*b* and 34*b* which are attached to the large circuit leads 24, 26, 32 and 34 respectively. The first pair of stationary contacts 24*b* and 26*b* are located next to each other on the left leg of the U-shaped base 32 near the bridge connecting the legs. This positions the first pair of stationary contacts 24*b* and 26*b* where they can be spanned or closed by a movable contact bar at one end of the armature assembly 16. The second pair of stationary contacts 32*b* and 34*b* are located in the same way on the right leg of the U-shaped base 32 where the second pair of stationary contacts 32*b* and 34*b* can be spanned or closed by a movable contact bar at the opposite end of the armature assembly 16. The armature assembly 16** operates in a seesaw fashion so that it closes one pair of stationary contacts while simultaneously opening the other.

The lead frame 12 also includes a surface mounted resistor 38 which is shunt connected to the smaller circuit leads 28 and 30 for energizing the coil assembly 20. The resistor 38 serves as a transient suppression device for an inductive electromagnetic coil of the coil assembly 20. The smaller circuit leads 28 and 30 have slotted ends **28*b* and 30*b* respectively which overhang the respective legs of the U-shaped base 36 at their free ends to provide electrical connections to the coil of the coil assembly 20**.

The larger circuit leads 24 and 34 have respective extensions **24*c* and 34*c* which also overhang the legs of the U-shaped base 36. Tips of the slotted ends 28*b* and 30*b* and the extensions 24*c* and 34*c* are exposed to the exterior of the relay 10 via suitable apertures (not shown) in the case 22 to provide probe contact points which allow for electrically testing the coil and one side of each switching circuit while the electromagnetic relay 10** is installed.

Figure 4:
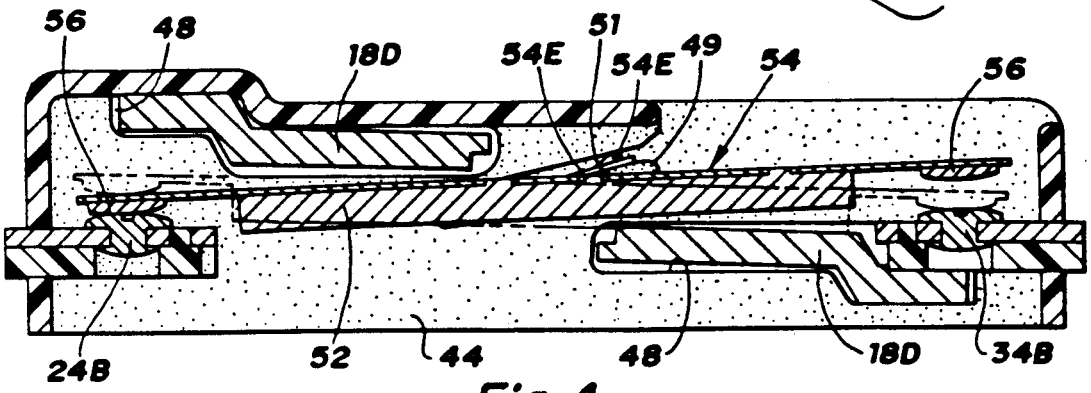
FIG. 4 is a section taken substantially along the line 4—4 of FIG. 3 looking in the direction of the arrows.

The armature frame 14 supports and positions the armature assembly 16 and parts of the electromagnetic frame 18 on the lead frame 12. The armature frame 14 is a molded thermoplastic shell which is generally in the form of a hollow rectangular parallelepiped. The armature frame 14 has two coplanar slots 40 at its respective opposite ends which extend through its front wall 42, its back wall 44 and its end walls 46. The armature frame 14 is mounted on the lead frame 12 by sliding the legs of the U-shaped lead frame 12 through the coplanar slots 40 until the front wall 42 abuts the bridge connecting the two legs. This positions the stationery contacts **24*b*, 26*b*, 32*b* and 34*b* inside the armature frame 14 as shown in FIG. 4**.

Figure 2:
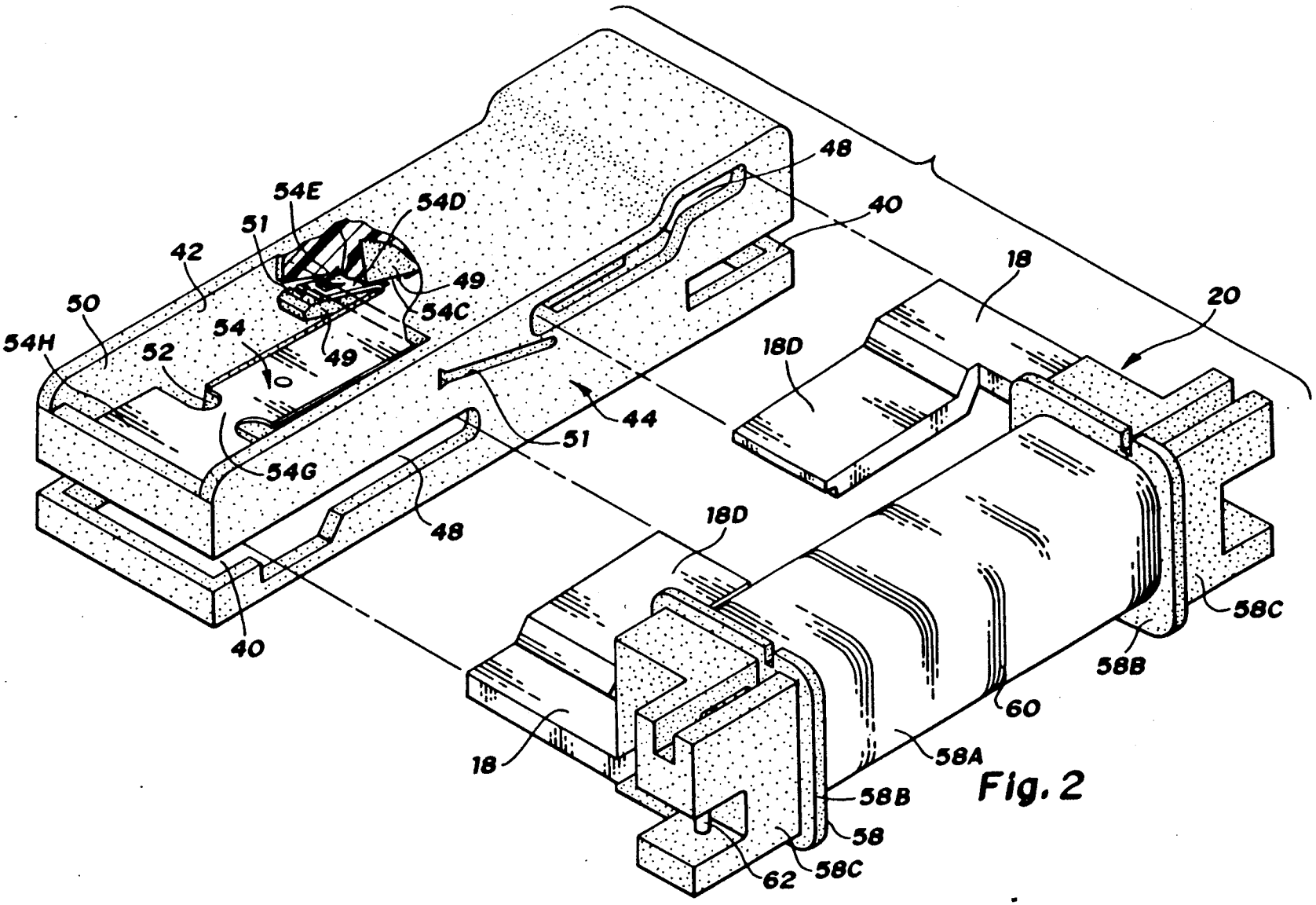
FIG. 2 is an exploded perspective view of several components of the flat electromagnetic relay which is shown in FIG. 1.

The back wall 44 of the armature frame 14 also has two diagonally related passages 48, one of which merges into one of the coplanar slots 40 as best shown in FIG. 2. These diagonally related slots receive parts of the electromagnetic frame 18 and position them in the armature frame 14 when the electromagnetic frame 18 and the coil assembly 20 are attached to the lead frame 12. The top of the armature frame 14 also has a large passage 50 through which the armature assembly 16 is inserted into the armature frame 14 and the front and back walls 42 and 44 each have interior projections 49 which provide inclined slots 51 for mounting the armature assembly 16 inside the armature frame 14.

The armature assembly 16 is a highly symmetrical balanced beam which comprises an armature 52, a support 54, and two contact bars 56. The support 54 is a thin, flat, strip of spring steel which has a rectangular body portion **54*a*** with coplanar extensions at each side and at each end.

The side extensions **54*b* comprise narrow webs 54*c* which extend out from the center of each side of the rectangular body 54*a* a short distance and then expand into wide attachment strips 54*d* for securing the armature assembly 16 inside the armature frame 14. When the armature assembly 16 is inserted into the armature frame 14 through the opening 50, these attachment strips 54*d* slide into the inclined slots 51 and are locked in place by lock tangs 54*e* which are formed out of the mounting strips 54*d* as shown in FIG. 2. When the armature assembly 16 is secured in this manner, the short narrow webs 54*c* establish an axis of rotation for the armature assembly 16 and act as torsion return springs which bias the armature assembly 16 in a first operative position. In this first operative position which is shown in solid lines in FIG. 4, the left contact bar 56 bridges the contacts 24*b* and 26*b* of a normally closed switching circuit while the right contact bar is spaced from the contacts 32*b* and 34*b*** of a normally open switching circuit.

The end extensions **54*f* of the support 54 comprise narrow webs 54*g* which extend out from each end of the rectangular body 54*a* a short distance and then expand into pads 54*h* to which the contact bars 56 are attached in a suitable manner. The short narrow webs 54*g* serve as leaf springs which increase contact pressure between the contact bars 56 and the stationary contacts 24*b*, 26*b*, 32*b* and 34*b* and which also allow for overtravel of the contact bars 56 when the armature 52** is pivoted from one operative position to the other.

The armature 52 is a rectangular strip of low carbon, magnetically soft steel which is attached to the bottom side of the support 54. When the armature 52 is exposed to an electromagnetic field produced by the electromagnetic frame 18 in conjunction with the coil assembly 20, a resultant Lorentz force causes the armature 52 to pivot toward the electromagnetic frame 18 to a second operative position and further twisting the torsion webs **54*c* in the process. In this second operative position which is shown in dotted lines in FIG. 4, the right contact bar 56 bridges the stationary contacts 32*b* and 34*b* of the normally open switching circuit while the stationary contacts 24*b* and 26*b* are simultaneously opened. Thus each of the contact bars 56 which are attached to the bottom of the pads 54*h* at opposite ends of the support 54 spans or closes one pair of stationary contact 24*b* and 26*b* or 32*b* and 34*b*** while the other pair is simultaneously opened.

The coil assembly 20 generates magnetic flux in the electromagnetic frame 18 and the armature 52 when the electromagnetic relay 10 is energized. The coil assembly 20 comprises a molded plastic bobbin 58, a coil 60 consisting of several consecutive wraps of insulated wire wound around the plastic bobbin 58, and solder pins 62 which are carried by the plastic bobbin for connecting the ends of the coil to the smaller circuit leads 28 and 30 of the lead assembly 12. The wire for coil 60 is preferably a fine gauge, 35 to 36 AWG typical, solid core copper wire with high temperature insulation.

The bobbin 58 comprises a thin wall, square shaped tube **58*a* with enlarged square flanges 58*b* located at each end of the tube. The inside of the tube 58*a* is also square shaped. The flanges 58*b* on each end of the tube 58*a* contain and protect the sides of the coil 60**.

The exterior sides of the flanges **58*b* have slotted mounting lugs 58*c* for mounting the coil assembly 20 on the lead frame 12 behind the armature frame 14 and armature assembly 16. The bobbin 58 is mounted on the lead frame 12 by sliding the legs of the U-shaped base 36 into the respective slotted mounting lugs 58*c* of the bobbin 58. Each of the slotted mounting lugs 58*c* carries one of the solder pins 62 so that the solder pins 62 are inserted into the slotted ends 28*b* and 30*b* of the smaller circuit leads 28 and 30 to automatically establish electrical connections to the coil 60 when the bobbin assembly 20 is attached to the lead frame 12**.

The electromagnetic frame 18 concentrates and directs the magnetic flux generated by the coil assembly 20 to opposite side ends of the armature 52 so that the resultant Lorentz force of the energized coil produces a moment which pivots the armature 52 into engagement with the electromagnetic frame 18, i.e. from the solid line position to the dotted line position shown in FIG. 4.

The electromagnetic frame 18 is generally C-shaped and comprises two identical "U" shaped steel pieces 18*a* and 18*b* which are made of low carbon, magnetically soft, steel. Each of the U-shaped electromagnetic frame pieces 18*a* and 18*b* has a long, narrow core leg 18*c* of rectangular cross section and a short, wide wing 18*d* formed from the opposite leg to act as a pole piece.

The electromagnetic frame pieces 18*a* and 18*b* are mounted on the coil assembly 20 by inserting their respective long, narrow core legs 18*c* into opposite ends of the square shaped tube 58*a* of the bobbin 58 which then holds the core legs 18*c* one on top of the other in a parallel overlapping arrangement. This mounting of the electromagnetic frame pieces 18*a* and 18*b* on the coil assembly 20 positions the short, wide wings 18*d* parallel to each other in a diagonal arrangement in front of the coil assembly 20 as best shown in FIG. 2. When the relay 10 is assembled, the wings 18*d* are positioned inside the armature frame 14 via the passages 48. In the assembled position, these short, wide wings 18*d* are located on diagonally opposite sides and ends of the armature 52 with air gaps between the wings 18*d* and the armature 52 when the coil 60 is deenergized as shown in solid lines in FIG. 4.

Figure 3:
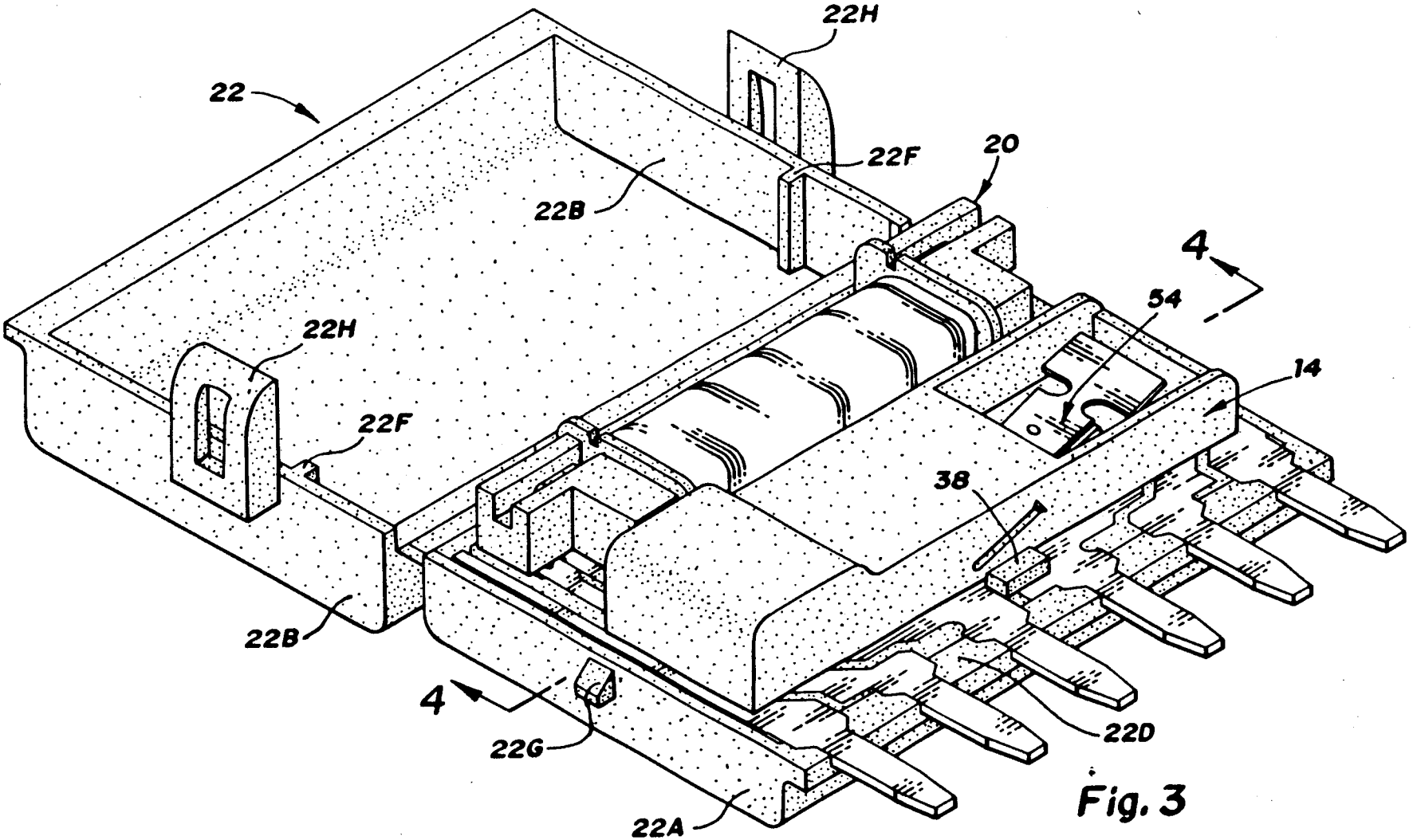
FIG. 3 is a perspective view of the flat electromagnetic relay which is shown in FIG. 1.

The electromagnetic relay 10 includes a case 22 to protect the components of the relay from physical damage from handling, installation, and environmental contamination. This case 22 comprises a thermoplastic tray 22*a* and an integrally hinged cover 22*b* which cooperatively house the components of the relay 10. More specifically, the sub-assembly comprising the lead frame 12 with the armature frame 14, armature assembly 16, electromagnetic frame 18 and coil assembly 20 mounted thereon is set into the housing tray 22*a* as shown in FIG. 3. The lead frame 12 is supported in the tray 22*a* by a plurality of support ribs 22*c*, a typical one of which is shown in FIG. 1. The edge 22*d* of the tray 22*a* which is opposite the integral hinge attaching the cover 22*b* has six slots 22*e* which allow the protruding male terminals 24*a*, 26*a*, 28*a*, 30*a*, 32*a* and 34*a* of the lead frame 14 to project out of the tray 22*a* as shown in FIG. 3. The cover 22*b* also has a plurality of ribs 22*f* which hold the lead frame 22 down when the cover 22*b* is closed. The cover 22*b* is locked in the closed position (not shown) by cooperating lock nibs 22*g* and lock arms 22*h* which are formed as part of tray 22*a* and the cover 22*b* respectively.

It should be noted that the flat electromagnetic relay 10 is characterized by a simple generally linear assembly of major components without any welding, soldering, fastening or securing required in the final assembly operation which eliminates any need for a cleaning operation after final assembly. During final assembly, the major components, i.e. the armature frame 14, armature assembly 16, electromagnetic frame 18 and coil assembly 20, are built up on the lead frame 12 and held in place by friction until placed in the tray 22*a* and the cover 22*b* is closed. The closed case 22 then retains the armature frame 14 and coil assembly 20 properly positioned on the lead frame 12.

I wish it to be understood that I do not desire to be limited to the exact details of construction shown and described, for obvious modifications will occur to a person skilled in the art.

The embodiments of the invention in which an exclusive property or privilege is claimed are defined as follows:

1. A flat electromagnetic relay comprising;

a frame which includes a pair of circuit leads and a pair of energizing leads, the pair of circuit leads having respective ones of a pair of stationary contacts which are next to each other, an armature assembly which is pivotally mounted on the frame for movement between first and second operative positions, the armature assembly including a movable contact bar which bridges the pair of contacts in the first operative position and which is spaced from the pair of contacts in the second operative position, a coil assembly mounted on the frame and electrically connected to the pair of energizing leads, an electromagnetic frame comprising a core leg which is inside a coil of the coil assembly and a wing which is adjacent one end of the armature assembly, the coil assembly when energized positioning the armature assembly in one of the first and second operative positions, and spring means biasing the armature assembly in another of the first and second operative positions.

2. The flat electromagnetic relay as defined in claim 1 wherein:

the coil assembly is mounted on the frame behind the armature assembly and electrically connected to the pair of energizing leads, and the electromagnetic frame is U-shaped having one leg forming the core leg and another leg forming the wing.

3. A flat electromagnetic relay comprising;

a frame which includes a pair of circuit leads and a pair of energizing leads, the pair of circuit leads having respective ones of a pair of stationary contacts which are next to each other, an armature assembly which includes a support having side extensions which are secured to the frame and which include torsion webs which bias the armature assembly to a first operative position and which allow the armature assembly to pivot on the frame between the first operative position and a second operative position, a coil assembly mounted on the frame and electrically connected to the pair of energizing leads, an electromagnetic frame comprising a core leg which is inside a coil of the coil assembly and a wing which is disposed adjacent an end of the armature assembly, the coil assembly when energized positioning the armature assembly in the second operative position against the bias of the torsion webs, and the armature assembly further including a movable contact bar mounted on the support which bridges the pair of stationary contacts in one of the first and second operative positions and which is spaced from the pair of stationary contacts in another of the first and second operative positions.

4. The flat electromagnetic relay as defined in claim 3 wherein:

the support is a single flat strip of spring steel.

5. The flat electromagnetic relay as defined in claim 4 wherein:

the coil assembly is mounted on the frame behind the armature assembly and electrically connected to the pair of energizing leads, and the electromagnetic frame is U-shaped having one leg forming the core leg and another leg forming the wing.

6. A flat electromagnetic relay comprising;

a frame which includes first and second pairs of circuit leads and a pair of energizing leads, the first pair of circuit leads having respective ones of a first pair of stationary contacts which are next to each other, the second pair of circuit leads having respective ones of a second pair of stationary contacts which are next to each other, an armature assembly which includes a support having side extensions which are secured to the frame and which include torsion webs which bias the armature assembly to a first operative position and which allow the armature assembly to pivot on the frame between the first operative position and a second operative position, a coil assembly mounted on the frame and electrically connected to the pair of energizing leads, an electromagnetic frame comprising a core leg which is inside a coil of the coil assembly and diagonally arranged wings which are disposed adjacent opposite side ends of the armature assembly, the coil assembly when energized positioning the armature assembly in the second operative position against the bias of the torsion webs, and the armature assembly further including first and second movable contact bars mounted on respective leaf spring extensions at the opposite ends of the support, the first movable contact bar bridging the first pair of contacts in the first operative position of the armature assembly and being spaced from the first pair of contacts in the second operative position, the second movable contact bar bridging the second pair of contacts in the second operative position and being spaced from the second pair of contacts in the first operative position.

7. The flat electromagnetic relay as defined in claim 6 wherein:

the support is a single flat strip of spring steel.

8. The flat electromagnetic relay as defined in claim 6 wherein:

the coil assembly is mounted on the frame behind the armature assembly and electrically connected to the pair of energizing leads, and the electromagnetic frame is generally C-shaped and comprises two U-shaped pieces, each piece having one leg forming the core leg and another leg forming one of the diagonally arranged wings, the core legs of the respective pieces being inserted into opposite ends of the coil.

9. A flat electromagnetic relay comprising;

a rigid thermoplastic lead frame which includes a pair of stamped circuit leads and a pair of stamped energizing leads which are insert molded in the lead frame, the pair of circuit leads having respective ones of a pair of stationary contacts which are next to each other, an armature frame mounted on the lead frame so that the pair of stationary contacts are in the armature frame, an armature assembly which includes a flat support having side extensions which are secured to the armature frame and which include torsion webs which bias the armature assembly to a first operative position and which allow the armature assembly to pivot on the armature frame between the first operative position and a second operative position, a coil assembly mounted on the frame and electrically connected to the pair of energizing leads, an electromagnetic frame comprising a core leg which is inside a coil of the coil assembly and a wing which is inside the armature frame and disposed adjacent an end of the armature assembly, the coil assembly when energized positioning the armature assembly in the second operative position against the bias of the torsion webs, and the armature assembly further including a movable contact bar mounted on the flat support which bridges the pair of stationary contacts in one of the first and second operative positions and which is spaced from the pair of contacts in another of the first and second operative position.

10. The flat electromagnetic relay as defined in claim 9 wherein the lead frame is U-shaped, the pair of stamped circuit leads are carried in one leg of the U-shaped lead frame and the pair of stamped energizing leads are carried in the respective legs of the U-shaped frame.

11. The flat electromagnetic relay as defined in claim 10 wherein the electromagnetic frame has a second wing disposed adjacent an opposite end of the armature assembly and the lead frame includes a second pair of stamped circuit leads which are insert molded in the lead frame and carried in the other leg of the U-shaped lead frame, the second pair of stamped circuit leads having respective ones of a second pair of stationary contacts which are next to each other and which are disposed in the armature frame.

12. The flat electromagnetic relay as defined in claim 11 wherein the stamped leads are shaped to provide six male blade terminals projecting from an edge of the lead frame which are coplanar, identical in width and evenly spaced.

13. The flat electromagnetic relay as defined in claim 11 wherein the armature assembly has a second movable contact bar at the opposite end which bridges the second pair of stationary contacts in the said another of the first and second operative positions.

14. The flat electromagnetic relay as defined in claim 13 wherein the armature frame is disposed behind a bridge connecting the legs of the U-shaped frame and has opposite ends mounted on the respective legs of the U-shaped frame.

15. The flat electromagnetic relay as defined in claim 10 wherein the pair of stamped energizing leads have slotted ends overhanging the free ends of the legs of the U-shaped frame, the coil assembly is mounted on the U-shaped frame by means of slotted lugs at the opposite ends of the coil assembly which are mounted on the respective legs of the U-shaped frame and the coil assembly includes solder pins disposed in the slotted lugs which are engaged by the slotted ends of the stamped energizing circuit leads when the coil assembly is mounted on the U-shaped frame.

16. The flat electromagnetic relay as defined in claim 11 further comprising a case having a tray and an integrally hinged cover which cooperatively house the lead frame, armature frame, armature assembly and coil assembly when the cover is closed.

17. The flat electromagnetic relay as defined in claim 16 wherein the tray supports the lead frame and the integrally hinged cover holds the lead frame down when the cover is closed.

18. The flat electromagnetic relay as defined in claim 17 wherein one stamped circuit lead of each pair of stamped circuit leads and the pair of stamped energizing leads have extensions overhanging the legs of the U-shaped base which are exposed to the exterior of the flat electromagnetic relay when the cover is closed to provide probe contact points which allow for electrically testing the coil and one side of each switching circuit while the flat electromagnetic relay is installed.

19. A flat electromagnetic relay comprising:

a frame which includes first and second pairs of circuit leads and a pair of energizing leads, the first pair of circuit leads having respective ones of a first pair of stationary contacts which are next to each other, the second pair of circuit leads having respective ones of a second pair of stationary contacts which are next to each other, an armature assembly which is pivotally mounted on the frame for movement between first and second operative positions, the armature assembly further including first and second movable contact bars, the first contact bar bridging the first pair of contacts in the first operative position of the armature assembly and being spaced from the first pair of contacts in the second operative position, the second movable contact bar bridging the second pair of contacts in the second operative position and being spaced from the second pair of contacts in the first operative position, a coil assembly mounted on the frame and electrically connected to the pair of energizing leads, an electromagnetic frame comprising a core leg which is inside a coil of the coil assembly and diagonally arranged wings which are disposed adjacent opposite side ends of the armature assembly, the coil assembly when energized positioning the armature assembly in one of the first and second operative positions, and spring means biasing the armature assembly in another of the first and second operative positions.

20. The flat electromagnetic relay as defined in claim 19 wherein:

the electromagnetic frame is generally C-shaped and comprises two U-shaped pieces, each piece having one leg forming the core leg and another leg forming one of the diagonally arranged wings, the core legs of the respective pieces being inserted into opposite ends of the coil.

21. The flat electromagnetic relay as defined in claim 20 wherein:

the armature assembly includes a support having side extensions which are secured to the frame and which include torsion webs which form the spring means biasing the armature assembly in one of the first and second operative positions and which allow the armature assembly to pivot on the frame between the first and second operative positions.

22. The flat electromagnetic relay as defined in claim 21 wherein:

the support is a single flat strip of spring steel, the coil assembly is mounted on the frame behind the armature assembly and electrically connected to the pair of energizing leads.

23. A flat electromagnetic relay comprising:

a frame which includes first and second pairs of stamped circuit leads and a pair of stamped energizing leads, the first pair of stamped circuit leads having respective ones of a first pair of stationary contacts which are next to each other, the second pair of stamped circuit leads having respective ones of a second pair of stationary contacts which are next to each other, an armature assembly which is pivotally mounted on the frame for movement between first and second operative positions, the armature assembly further including first and second movable contact bars, the first contact bar bridging the first pair of contacts in the first operative position of the armature assembly and being spaced from the first pair of contacts in the second operative position, the second movably contact bar bridging the second pair of contacts in the second operative position and being spaced from the second pair of contacts in the first operative position, a coil assembly mounted on the frame and electrically connected to the pair of stamped energizing leads, an electromagnetic frame comprising a core leg which is inside a coil of the coil assembly and diagonally arranged wings which are disposed adjacent opposite side ends of the armature assembly, the coil assembly when energized positioning the armature assembly in one of the first and second operative positions, and spring means biasing the armature assembly in another of the first and second operative positions.

24. The flat electromagnetic relay as defined in claim 23 wherein the stamped leads are shaped to provide six male blade terminals projecting from an edge of the frame which are coplanar, identical in width, and evenly spaced.

* * * * *